United States Patent [19]

Dusko

[11] Patent Number: 4,590,822

[45] Date of Patent: May 27, 1986

[54] BEVERAGE CAN OPENING APPARATUS

[76] Inventor: Carl E. Dusko, 1407 11th Ave. South, Great Falls, Mont. 59405

[21] Appl. No.: 726,655

[22] Filed: Apr. 23, 1985

[51] Int. Cl.[4] ..... B67B 7/40

[52] U.S. Cl. ..... 81/3.55; 81/3.25; 30/400; 30/410

[58] Field of Search ..... 30/410–429; 81/3.55, 3.25

[56] References Cited

U.S. PATENT DOCUMENTS

| | | | |
|---|---|---|---|
| 1,341,513 | 5/1920 | Morange | 30/400 X |
| 2,939,605 | 7/1960 | Bliss | 30/410 X |
| 4,455,895 | 6/1984 | Christensen | 81/3.55 |
| 4,466,313 | 8/1984 | Gardner | 81/3.55 |

*Primary Examiner*—E. R. Kazenske
*Assistant Examiner*—Willmon Fridie, Jr.
*Attorney, Agent, or Firm*—Arthur L. Urban

[57] ABSTRACT

Beverage can opening apparatus includes a base portion, a support portion, a can engaging portion, a biasing portion and a fastening portion. The base portion includes a substantially flat plate section. The support portion includes spaced shaft supporting sections disposed adjacent opposed elongated edges of the plate section with each including an opening in a plane parallel to one of the elongated edges, the openings being spaced from the plate section. A shaft extends between the openings of the shaft supporting sections. The can engaging portion includes an elongated member pivotally connected at one end to the shaft and extending therefrom toward and beyond one end of the plate section. The elongated member includes a slot at a free end thereof beyond the plate section, the slot being aligned substantially parallel to the plate section. The elongated member includes a channel extending from the slot toward the support portion, the channel having a cross section substantially the same as the slot. The biasing portion includes a coil spring member carried axially on the shaft including a coiled section and an elongated section at each end thereof extending in opposite directions from the coiled section with one in contact with the can engaging portion and the other with the plate section. The fastening portion includes a threaded member extending through the plate section adjacent an end thereof remote from the slot of the can engaging portion.

13 Claims, 6 Drawing Figures

BEVERAGE CAN OPENING APPARATUS

This invention relates to a new novel can opening apparatus and more particularly relates to a new apparatus for opening beverage cans.

Beverages have been stored in a wide variety of different containers throughout history. Originally, beverages such as water, milk, beer, wine and the like were stored in pottery jars, skins, metal cans and similar containers. Usually, the top was covered with a slab or fabric to keep out contaminants. With the development of glass containers, many beverages were stored in glass bottles and jars.

As society tended to congregate in towns and cities, beverages had to be transferred greater distances from the producer to the consumer. In these circumstances, containers needed to be enclosed more tightly to prevent contamination and spillage. Special caps were developed to fit particular product containers. Milk bottles had paper caps; wine bottles, corks; beer and soft drink bottles, metal caps.

Through the years, single serving beverage containers greatly increased in popularity. This necessitated that people ordinarily purchase a number of bottles at one time, either in 6 packs or in 12 or 24 bottle cases.

Since the cost of the glass containers was a significant expense, beverage sellers charged a deposit for the bottles which was refundable when the empty bottles were returned. Although in theory this system provided a satisfactory solution, in practice, returning bottles for the deposit was a nuisance. Since the beverages normally were consumed away from the place of purchase, it was necessary for the consumer to store the empty bottles until the next trip to a store. Also, the merchants did not like to handle the empty bottles because of the time involved in completing this profitless transaction.

Another consideration for the merchant was that after he had received the bottles, he still had to find space to store the empties until the beverage distributor made his next periodic visit to pick up the bottles. Since some people returned the empty bottles without rinsing them, the small amounts of liquid remaining could attract flies and vermin and thereby create problems including health hazards and safety. Thus the merchant might have to provide an enclosed storage area.

Another negative factor with glass containers was the difficulty in keeping the bottles circulating within the system. Unless a relatively large deposit was charged, the consumer had little motivation to take the time and effort to return the empties. However, if consumers considered the deposit too high, they would voice their displeasure and might restrict their purchases.

Because of these complications, beverage packagers turned to metal containers. While such containers did not require a deposit and thus were widely accepted by the consumers, they were not without their own problems. Opening the containers required different procedures from the cap removal steps normally followed with glass bottles.

Can openers were used initially with metal cans but this required that a can opener be kept at hand. Later, pull tabs were developed that were attached to each can. Pull tabs had their own shortcomings, however. The small tabs that were removed had to be discarded somewhere. Unless a person was very diligent, the tabs ended up in inappropriate places where they were unsightly and perhaps hazardous. In an attempt to overcome these problems, new pull tabs were developed that were retained in the can even after it was opened.

With both types of tabs, the cans were opened by raising one end of the tab away from the can top. This movement separated a scored section from the top and thus created an opening for access to the contents. With the first tabs, the scored section with the tab was separated as a unit, whereas with currently used tabs, the tab stays in place and the scored section is bent into the can.

Although for many people this design functions satisfactorily, some persons found the design less than satisfactory. Individuals with limited finger dexterity find the pull tabs difficult to manipulate. Some ladies dislike pull tabs because they may break fingernails using them. Commercial establishments that open many beverage cans daily find pull tabs troublesome because of the sore fingers their employees develop and the considerable time spent on the task.

From the above discussion, it is clear that present and past methods and devices do not provide a desirable solution to the problems many people encounter in opening beverage containers. Thus, there is a need for a new procedure for opening beverage containers that overcomes the deficiencies of current methods.

The present invention provides a novel beverage can opening apparatus with features and advantages not found in earlier methods and devices. The apparatus of the invention enables an individual with restricted finger dexterity to open beverage cans easily. Thus, persons with arthritis in their fingers or with stiff fingers because of injury or other causes can open beverage cans conveniently. Also, the breaking of fingernails and abrasion of the fingers is eliminated with the can opening apparatus. In addition, commercial establishments can open large numbers of cans quickly and simply with the apparatus.

The beverage can opening apparatus of the present invention is simple in design and can be produced relatively inexpensively. Commercially available materials and components can be used in its manufacture. The apparatus can be fabricated utilizing conventional metal working techniques and procedures and semi-skilled labor.

The can opening apparatus can be installed easily and quickly on a variety of supporting surfaces such as shelf and counter edges, under cupboards, on vending machines, walls, stands and the like. The apparatus is durable in construction and requires little if any maintenance. The apparatus can be modified to accommodate different cans and pull tab designs.

Persons of all ages are able to use the opening apparatus efficiently after only a minimum of instruction. Young children and the elderly find the can opening apparatus of the invention to be especially useful.

Other advantages and benefits of the novel beverage can opening apparatus of the present invention will be apparent from the following description and the accompanying drawings in which.

Figure 1:
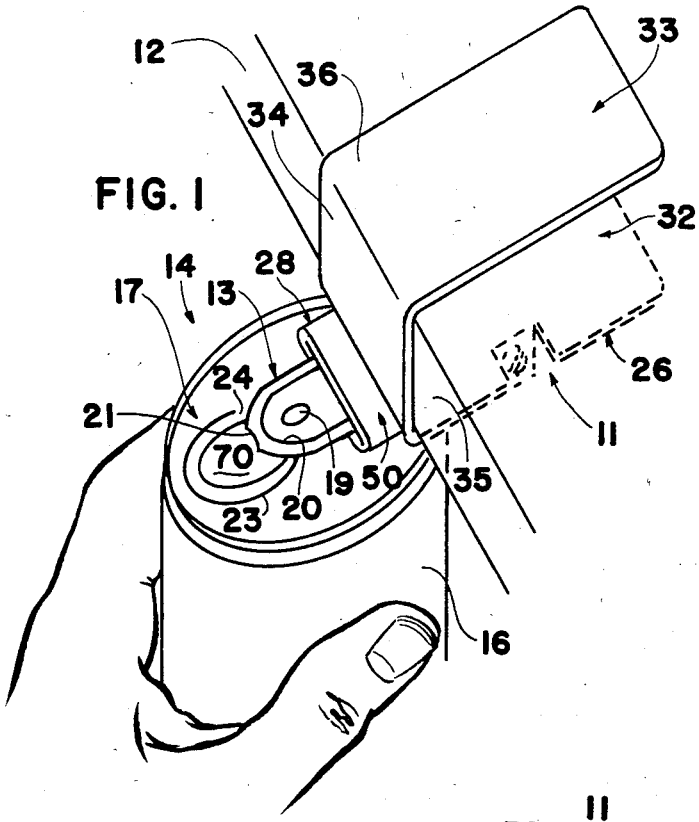
FIG. 1 is a view in perspective of one form of the beverage can opening apparatus of the invention in use.
Figure 2:
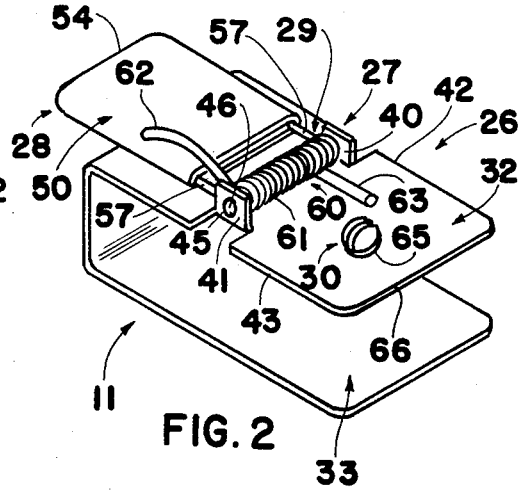
FIG. 2 is an inverted view in perspective of the beverage can opening apparatus shown in FIG. 1.

As shown in the drawings, one form of the novel beverage can opening apparatus 11 of the present invention is mounted on a shelf or table edge 12. A pull tab 13 of a beverage can 14 has been placed into engagement with the apparatus 11 prior to opening of the can.

The can 14 includes a cylindrical sidewall section 16, a top section 17 and a bottom section (not shown). The pull tab 13 is affixed to the top section with a rivet 19 located at the center of the top section. The rivet passes through the pull tab adjacent to a curved end 20 thereof that includes a cutout section 21.

The top section 17 includes a scored line 23 that starts under the pull tab 13 adjacent the rivet 19 and continues in an oval configuration back to a point adjacent the opposite side of the rivet but spaced a short distance therefrom to form an unscored section 24.

The beverage can opening apparatus 11 of the present invention includes a base portion 26, a support portion 27, a can engaging portion 28, a biasing portion 29 and a fastening portion 30.

The base portion 26 of the beverage can opening apparatus 11 of the invention includes a substantially flat plate section 32. Advantageously, the plate section is elongated and has a generally quadrangular configuration such as the rectangular section shown in the drawings.

The base portion preferably also includes a second plate section 33 that is spaced from the first plate section 32 and is parallel thereto. The first and second plate sections 32 and 33 are joined by a transverse section 34. The transverse section is located adjacent ends 35 and 36 of the plate sections adjacent the can engaging portion 28 of the opening apparatus 11.

The support portion 27 of the can opening apparatus 11 includes spaced shaft supporting sections 40 and 41. The shaft supporting sections are disposed adjacent opposed elongated edges 42 and 43 of the plate section 32. The shaft supporting sections 40 and 41 are disposed substantially parallel to each other.

Advantageously, the shaft supporting sections 40 and 41 include sections cut from the plate section 32 as shown in the drawings and bent substantially perpendicular thereto. The shaft supporting sections may have generally quadrangular configurations.

Each of the shaft supporting sections 40 and 41 includes an opening 44 or 45 in a plane parallel to one of the elongated edges 42 and 43. The openings are spaced from the plate section 32. A shaft 46 extends between the openings of the shaft supporting sections.

The can engaging portion 28 of the beverage can opening apparatus 11 of the invention includes an elongated member 50. The elongated member 50 is pivotally connected at one end 51 to the shaft 46. The elongated member extends from the shaft toward and beyond one end 52 of the plate section 32.

The elongated member 50 includes a slot 53 at a free end 54 thereof. The slot 53 is disposed beyond the end 52 of the plate section. The slot is aligned substantially parallel to the end 52 of the plate section 32.

The elongated member 50 also includes a channel 56. The channel extends from the slot of the elongated member toward the support portion 27. The channel has a cross section substantially the same as the slot 53.

The elongated member 50 advantageously may be a deformed conduit as shown in the drawings, the conduit serving both as the slot 53 and the channel 56. The elongated member may be connected to the shaft 46 through hinge members 57. The elongated member preferably extends beyond the end 52 of the plate section between about one-fourth and one-half the elongated member's length.

The biasing portion 29 of the can opening apparatus 11 includes a coil spring member 60. The coil spring 60 is carried axially on shaft 46. The coil spring member includes a coiled section 61 and an elongated section 62 and 63 at each end thereof. The elongated sections 62 and 63 extend in opposite directions from the coiled section and substantially perpendicular to the axis thereof. One of the elongated sections is in contact with the can engaging portion 28 and the other elongated section is in contact with the plate section 32.

The elongated sections 62 and 63 of the coil spring member 60 advantageously are disposed substantially parallel to the plate section 32 and the can engaging portion 28. The elongated sections preferably have lengths less than that of the coiled section.

The fastening portion 30 of the beverage can opening apparatus 11 includes a threaded member 65. The threaded member extends through the plate section 32. The threaded member 65 is disposed adjacent an end 66 of the plate section that is remote from the slot 53 of the can engaging portion 28.

Advantageously, the threaded member 65 is disposed substantially perpendicular to the plate section. The threaded member preferably tapers to a point. The fastening portion 30 may include more than one threaded member spaced along the length of the plate section 32.

The beverage can opening apparatus 11 of the present invention may be fabricated from any of a wide variety of different materials such as steel, aluminum, plastics, combinations thereof and the like.

In the use of the can opening apparatus 11 of the invention as shown in the drawings, the apparatus first is mounted in a convenient location. Suitable locations include under cupboards or shelves wherein the apparatus would only include a single plate section 32. Alternatively, the apparatus may be mounted on the edge of a counter, table, shelf, etc. and utilize a pair of spaced plate sections 32 and 33. In the same way, the apparatus may be mounted on a stand or other desired supporting assemblies. In any case, the fastening portion 30 secures the apparatus to the support selected. The apparatus now is ready for use.

To open a beverage can 12 that has a pull tab opening mechanism, the sidewall 16 of the can is grasped between the thumb and fingers. Then, the pull tab 13 is inserted into the slot 53 and the tab pushed along the channel 56.

Figure 3:
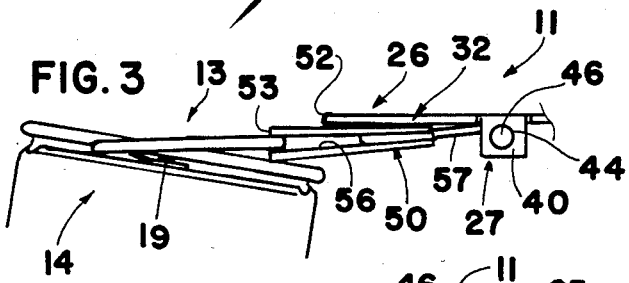
FIG. 3 is a fragmentary side view in section of the beverage can opening apparatus shown in FIG. 1 as the pull tab of the can is being inserted therein.
Figure 4:
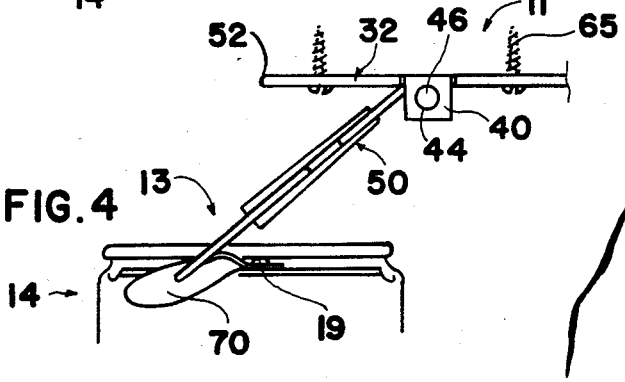
FIG. 4 is a fragmentary side view in section of the beverage can opening apparatus shown in FIG. 3 as forward and downward pressure is being applied to the can.
Figure 6:
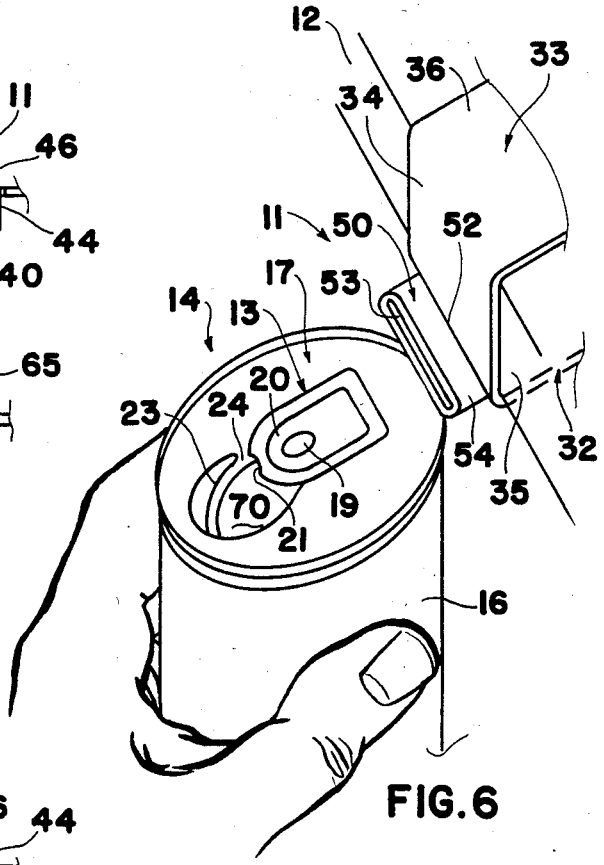
FIG. 6 is a view in perspective of the beverage can opening apparatus shown in FIG. 1 after the can is opened as the pull tab and the can are being withdrawn.
Figure 5:
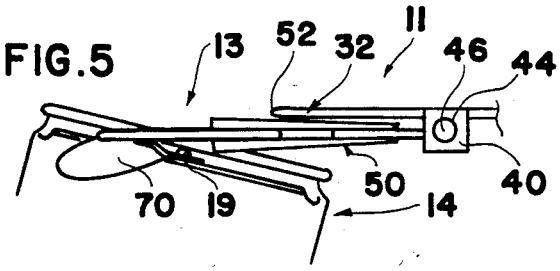
FIG. 5 is a fragmentary side view in section of the beverage can opening apparatus of FIGS. 3 and 4 as pressure is released after the can has been opened.

With the tab firmly within the channel, the can is pushed forward and downward so that the can engaging portion 28 pivots about the shaft 46 from a horizontal position as shown in FIG. 3 to a more vertical position as shown in FIG. 4. This action causes the pull tab 13 to be tilted upward so that the end 20 thereof is pushed downwardly against the oval shaped area 70 of the top section 17 within the scored line 23. Since the scored line creates weakness in the top section, the scored line breaks under the pressure from the tilted pull tab and the oval area is pushed into the can in the same way as when the can is opened with finger pressure conventionally. Since section 24 of the top section is not scored, the oval area 70 that is pushed into the can is still connected to the top section and retained as a part thereof. The pull tab and the can then are separated from the opening apparatus and replaced with another can.

Although the can is opened in the same way as when the task is performed manually, the use of the opening apparatus of the invention provides a number of important advantages. Persons who have limited use of their fingers are able to open cans easily. Even if an individual has normal finger dexterity, using the opening apparatus eliminates broken fingernails, cuts and similar injuries.

Persons of all ages, including the very young and the elderly use the apparatus easily and conveniently. Employees of commercial establishments that open large numbers of cans each day are able to perform the task more quickly and simply.

The design of the can opening apparatus of the invention is relatively simple and can be produced inexpensively with commercially available materials and components using conventional fabrication techniques. The apparatus is durable in construction and has a long useful life without significant maintenance. The apparatus can be adapted to accommodate different size cans and special installations.

It will be apparent that various modifications can be made in the particular beverage can opening apparatus described in detail above and shown in the drawings within the scope of the present invention. The size, configuration and arrangement of components can be changed to meet specific requirements. The elongated member may be bent along the length thereof to permit the plate section to be mounted vertically. The hinge members may be formed integrally with the elongated member. These and other changes can be made in the beverage can opening apparatus of the invention provided the functioning and operation thereof are not adversely affected. Therefore, the scope of the present invention is to be limited only by the following claims.

What is claimed is:

1. Beverage can opening apparatus including a base portion, a support portion, a can engaging portion, a biasing portion and a fastening portion; said base portion including a substantially flat plate section; said support portion including spaced shaft supporting sections disposed adjacent spaced elongated edges of said plate section, said shaft support sections being disposed substantially parallel to each other, each of said shaft supporting sections including an opening in a plane parallel to one of said elongated edges, said openings being spaced from said plate section, a shaft extending between said openings of said shaft supporting sections; said can engaging portion including an elongated member pivotally connected at one end to said shaft and extending therefrom toward and beyond one end of said plate section, said elongated member including a slot at a free end thereof beyond said plate section, said slot being aligned substantially parallel to said plate section, said elongated member including a channel extending from said slot toward said support portion, said channel having a cross section substantially the same as said slot; said biasing portion including a coil spring member carried axially on said shaft, said coil spring member including a coiled section and an elongated section at each end thereof extending in opposite directions from said coiled section substantially perpendicular to the axis thereof, one of said elongated sections being in contact with said can engaging portion and the other elongated section being in contact with said plate section; said fastening portion including a threaded member extending through said plate section adjacent an end thereof remote from said slot of said can engaging portion; whereby applying forward and downward pressure to a beverage can having its pull tab inserted into said slot of said can engaging portion will cause pivoting thereof downwardly away from said plate section and simultaneously tilting of said tab to open said can.

2. Beverage can opening apparatus according to claim 1 wherein said base portion includes a second plate section spaced from and parallel to said first plate section, said first and second plate sections being joined by a transverse section located adjacent ends thereof adjacent said slot of said can engaging portion.

3. Beverage can opening apparatus according to claim 1 wherein said plate section has a generally rectangular configuration.

4. Beverage can opening apparatus according to claim 1 wherein said shaft supporting sections are cut sections of said plate section bent substantially perpendicular thereto.

5. Beverage can opening apparatus according to claim 1 wherein said shaft supporting sections have a generally quadrangular configuration.

6. Beverage can opening apparatus according to claim 1 wherein said elongated member of said can engaging portion is a deformed conduit.

7. Beverage can opening apparatus according to claim 1 wherein said elongated member is connected to said shaft through hinge members.

8. Beverage can opening apparatus according to claim 1 wherein said elongated member extends beyond an end of said plate section between about one-fourth and one-half its length.

9. Beverage can opening apparatus according to claim 1 wherein said elongated sections of said coil spring member are disposed substantially parallel to said plate section and said elongated member of said can engaging portion.

10. Beverage can opening apparatus according to claim 1 wherein said elongated sections have lengths less than that of said coiled section.

11. Beverage can opening apparatus according to claim 1 wherein said threaded member of said fastening portion is disposed substantially perpendicular to said plate section.

12. Beverage can opening apparatus according to claim 1 wherein said threaded member tapers to a point.

13. Beverage can opening apparatus according to claim 1 wherein said fastening portion includes more than one threaded member spaced along the length of the plate section.

* * * * *